US005477774A

United States Patent [19]

Ikumi

[11] Patent Number: 5,477,774

[45] Date of Patent: Dec. 26, 1995

[54] CYLINDER DEVICE

[75] Inventor: Taishi Ikumi, Ibaraki, Japan

[73] Assignee: SMC Kabushiki Kaisha, Tokyo, Japan

[21] Appl. No.: 314,625

[22] Filed: Sep. 29, 1994

[30] Foreign Application Priority Data

Oct. 7, 1993 [JP] Japan ..... 5-054523 U

[51] Int. Cl.[6] ..... F01B 29/00

[52] U.S. Cl. ..... 92/161; 92/164; 92/163; 92/5 R

[58] Field of Search ..... 92/161, 146, 164, 92/163, 169.1

[56] References Cited

U.S. PATENT DOCUMENTS

| | | | |
|---|---|---|---|
| 2,798,777 | 7/1957 | Flick et al. | 92/161 |
| 3,043,639 | 7/1962 | Maha | 92/161 |
| 3,371,923 | 3/1968 | Blatt | 92/161 |
| 3,688,646 | 9/1972 | Flick et al. | 92/146 |
| 4,827,835 | 5/1989 | LaBair | 92/161 |
| 4,982,652 | 1/1991 | Blatt | 92/169.1 |

FOREIGN PATENT DOCUMENTS

| | | | |
|---|---|---|---|
| 54753 | 1/1935 | Norway | 92/161 |
| 784360 | 10/1957 | United Kingdom | 92/161 |

OTHER PUBLICATIONS

Mannesmann Rexroth, Jan. 1987, pp. 550–551 & 574–575, "Hydraulic Components".

FESTO Pneumatic, 3 pages (with partial English translation).

*O–M Bulletin No. 105,* pp. 1–2 dated Dec. 1959.

*Primary Examiner*—Thomas E. Denion

*Attorney, Agent, or Firm*—Oblon, Spivak, McClelland, Maier & Neustadt

[57] ABSTRACT

For attaching a cylinder device to an attachment surface extending perpendicularly to the axis of a piston rod, bolts are inserted through attachment holes which are defined in a rod cover and extend along the axis of the piston rod. A cylinder tube has recesses defined in respective four corners thereof for allowing the bolts to be inserted from a head cover toward the rod cover without being obstructed by the four corners of the cylinder tube. The cylinder device can thus be attached to the attachment surface with utmost ease.

5 Claims, 4 Drawing Sheets

CYLINDER DEVICE

BACKGROUND OF THE INVENTION

1. Field of the Invention

The present invention relates to a cylinder device, and more particularly to a cylinder device which can easily be mounted on an attachment surface extending along or perpendicularly to the axis of a piston rod, through attachment holes defined in a rod cover.

2. Description of the Related Art

Heretofore, there have been available three structures by which a cylinder can be installed on an attachment surface.

According to a first configuration known as a so-called foot-type attachment, a pair of attachment plates are fixed to respective longitudinal ends of a cylinder tube, and bolts are threaded into the attachment plates in a direction normal to the piston rod, thereby securing the cylinder in position.

A second structure referred to as a flange-type structure has an attachment flange disposed on the rod or head end of a cylinder tube. The cylinder is fixed in place by a bolt that is threaded into the attachment flange along the axis of the piston rod.

In a third pivot-type attachment configuration, a pivot is formed on the head end of a cylinder tube, and a pin is inserted through a pin hole defined in the pivot perpendicularly to the axis of the piston rod, thus fastening the cylinder in position.

With the conventional attachment schemes, each cylinder demands a certain specific attachment surface, and, once attached, cannot change attachment surfaces depending on the environment in which it is installed.

SUMMARY OF THE INVENTION

It is therefore an object of the present invention to provide a cylinder device which is capable of changing attachment surfaces depending on the environment in which it is installed.

According to the present invention, the above object can be achieved by a cylinder device comprising a cylinder body having a cylinder chamber and first and second ports defined therein, and a piston mounted in the cylinder chamber for reciprocating movement in response to introduction of a fluid under pressure through one of the first and second ports and discharge of a fluid under pressure through the other of the first and second ports, a piston rod connected to the piston and extending in the cylinder chamber, the cylinder body including a rod cover, a cylinder tube, and a head cover which are integrally coupled to each other, the rod cover having a plurality of first attachment holes defined therein and extending therethrough along an axis of the piston rod, and a plurality of second attachment holes defined therein and extending therethrough perpendicularly to the axis of the piston rod, the cylinder tube having recesses defined respectively in four corners thereof and extending perpendicularly to the axis of the piston rod.

The cylinder device further comprises positioning means for positioning the cylinder body when the cylinder body is attached in place through the first attachment holes or the second attachment holes.

The positioning means comprises a positioning recess defined in at least one side surface of the rod cover for use in attaching the cylinder body to an attachment surface which extends along the axis of the piston rod, and a bushing of a substantially circular cross section projecting from the rod cover along the axis of the piston rod for use in attaching the cylinder body to an attachment surface which extends perpendicularly to the axis of the piston rod.

The cylinder device is used as follows: The operator selects desired ones of the first and second attachment holes depending on the environment in which the cylinder device is to be installed, and fastens the cylinder device to a attachment surface with bolts extending through the selected attachment holes. It is easy for the operator to change attachment surfaces for the cylinder device by selecting desired ones of the first and second attachment holes.

Specifically, when the cylinder device is to be mounted on an attachment surface extending perpendicularly to the axis of the piston rod, bolts are inserted through the second attachment holes which extend along the axis of the piston rod, thus fixing the cylinder device to the attachment surface. At this time, the cylinder body is accurately positioned by the bushing (second positioning means) fitted in an attachment hole defined in the attachment surface.

If the bolts are inserted from the head cover toward the rod cover, the recesses defined in the respective corners of the cylinder tube allow the bolts to be inserted without being obstructed by the corners of the cylinder tube. The cylinder device can thus be positioned and installed with ease.

When the cylinder device is to be mounted on an attachment surface extending along the axis of the piston rod, bolts are inserted through the first attachment holes which extend perpendicularly to the axis of the piston rod, thus fixing the cylinder device to the attachment surface. At this time, the cylinder body is accurately positioned by the positioning recess (first positioning means) which is fitted over a tooth on the attachment surface. The cylinder device can thus be positioned and installed easily.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
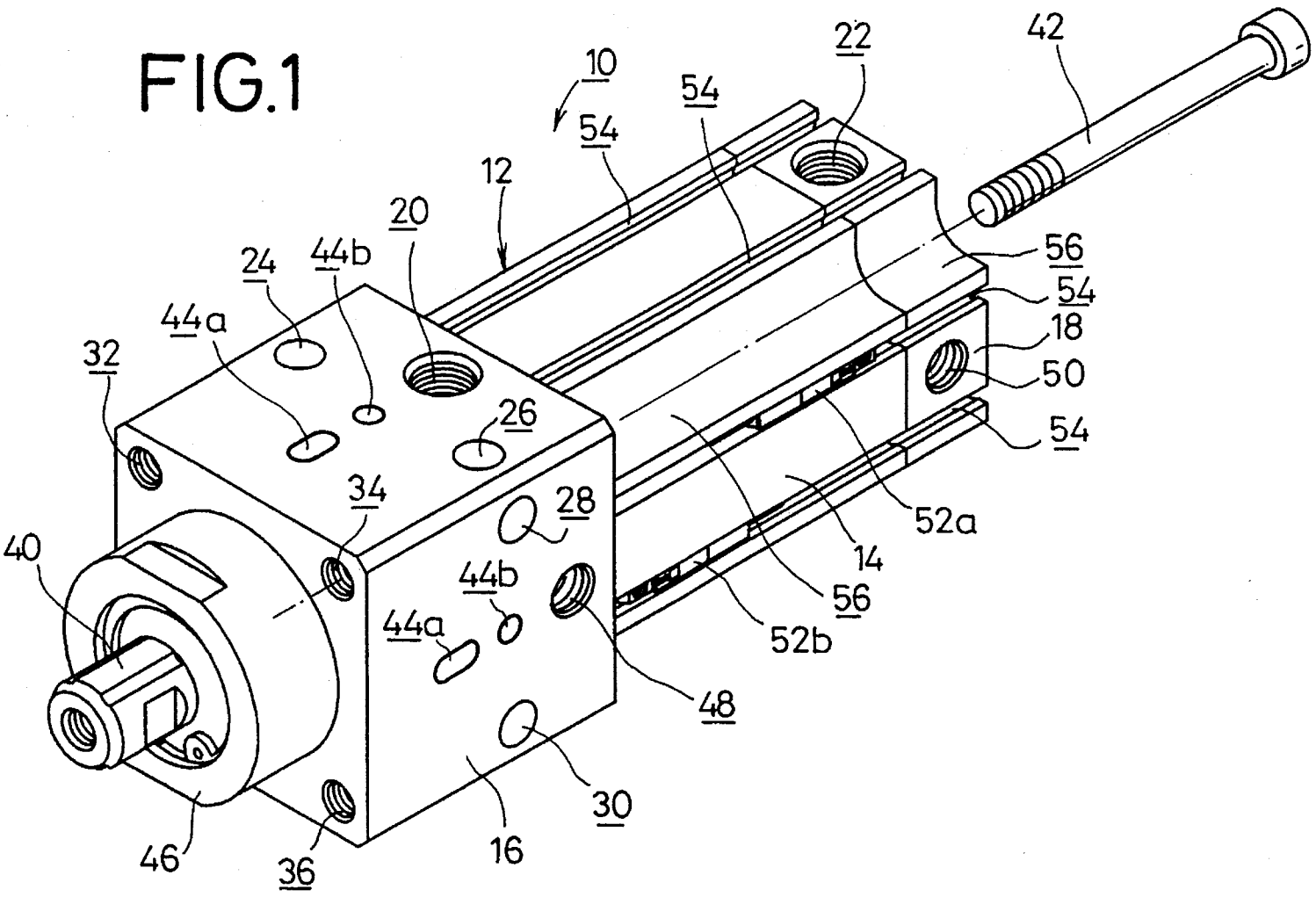
FIG. 1 is a perspective view of a cylinder device according to the present invention.

As shown in FIG. 1, a cylinder device 10 according to the present invention has a cylinder body 12 comprising an elongate cylinder tube 14, a rod cover 16 in the form of a substantially rectangular parallelepiped integrally coupled to an end of the cylinder tube 14, and a head cover 18 integrally coupled to the other end of the cylinder tube 14.

The rod cover 16 and the head cover 18 have pressure fluid inlet/output ports 20, 22, respectively, defined in their upper surfaces. The rod cover 16 has a plurality of attachment holes 24, 26, 28, 30, 32, 34, 36, 38 (see FIGS. 1 and 3) defined in all side surfaces thereof and extending all the way to opposite side surfaces. The attachment holes 24, 26, 28, 30, 32, 34, 36, 38 are selectively used depending on the attachment surface to which the cylinder device 10 is to be attached. Each of side surfaces of the rod cover 16 also has positioning recesses 44*a*, 44*b* (see also FIGS. 2 and 4) defined therein along the axis of a piston rod 40 (see FIGS. 1 and 2) which will be described later on.

When the cylinder device 10 is to be attached to an attachment surface (see FIG. 2) which extends along the axis of the piston rod 40, the attachment holes 24, 26, 28, 30 are selected. Then, bolts 42 are inserted through the selected attachment holes 24, 26, 28, 30 in a direction substantially perpendicular to the axis of the piston rod 40, fastening the cylinder device 10 to the attachment surface. At this time, teeth 45*a*, 45*b* on the attachment surface engage in respective positioning recesses 44*a*, 44*b* in the corresponding side surface of the rod cover 16. Therefore, the cylinder device 10 can be positioned on and fixed to the attachment surface highly accurately.

When the cylinder device 10 is to be attached to an attachment surface which extends substantially perpendicularly to the axis of the piston rod 40, bolts 42 are inserted through the attachment holes 32, 34, 36, 38 which are defined closely to the respective four corners of the rod cover 16. The bolts 42 may be inserted from either the side of the head cover 18 or the side of a bushing 46 on the piston rod 40.

The rod cover 16 and the head cover 18 have needle valve adjustment holes 48, 50, respectively, defined in side surfaces thereof.

Figure 3:
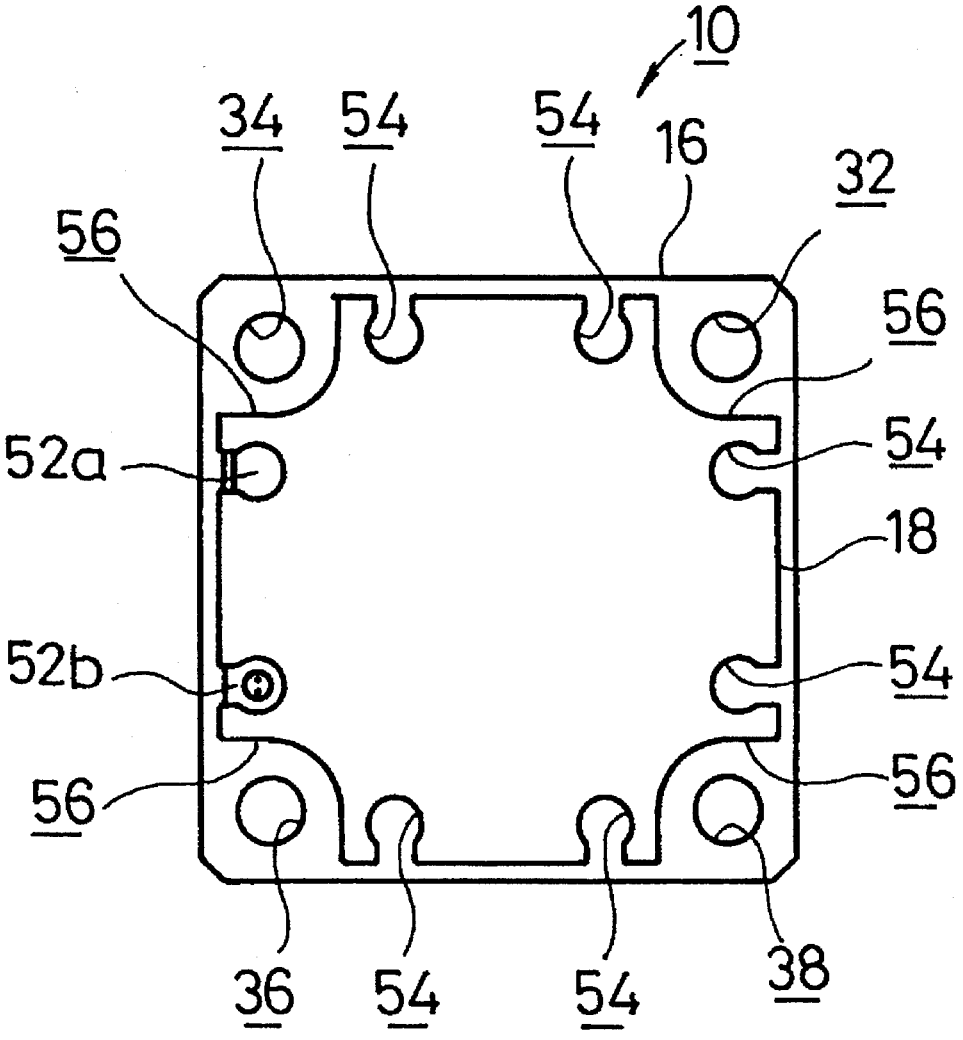
FIG. 3 is a side elevational view of the cylinder device shown in FIG. 1.
Figure 4:
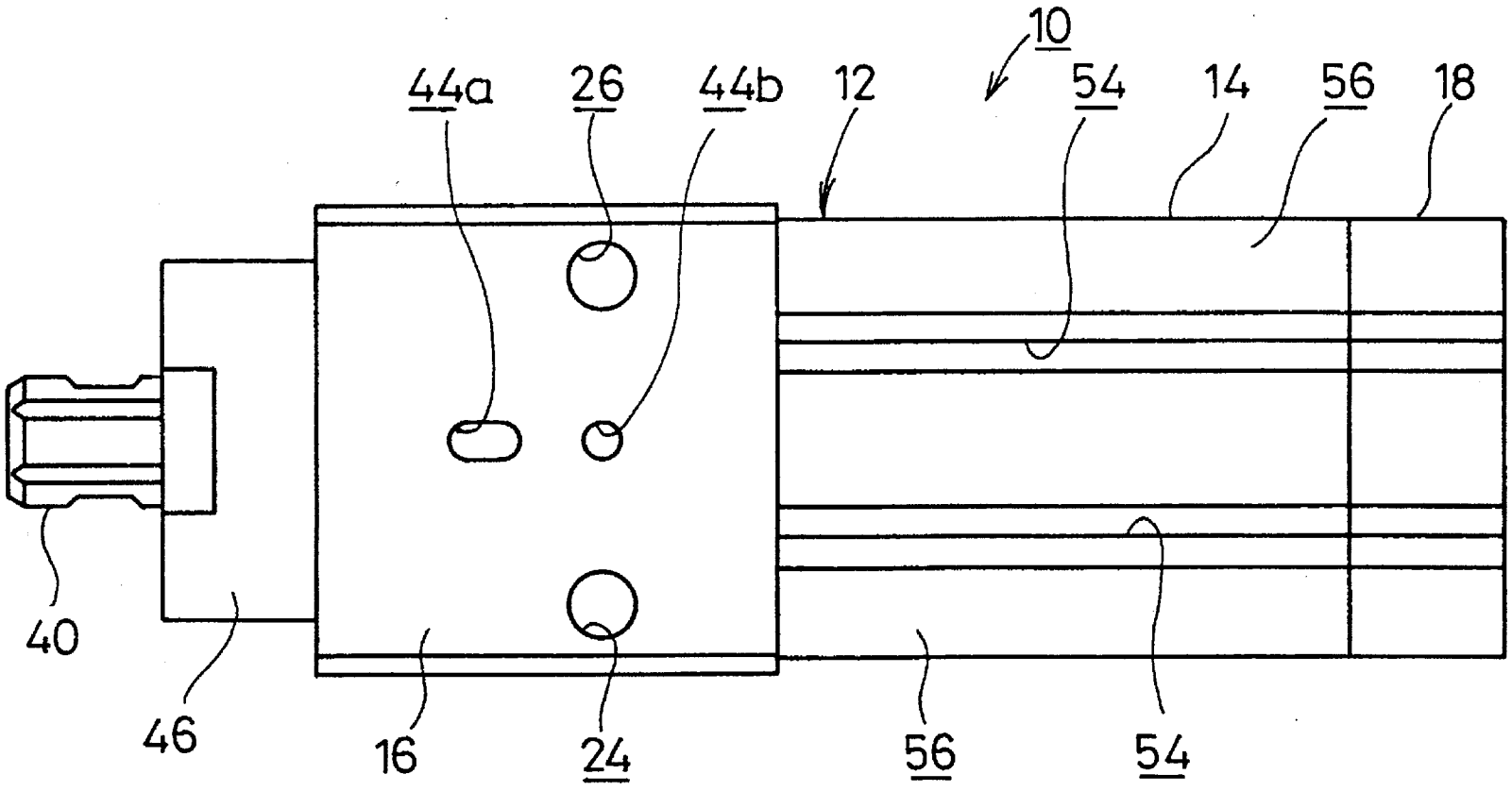
FIG. 4 is a bottom view of the cylinder device shown in FIG. 1.

Each of the cylinder tube 14 and the head cover 18 has a pair of substantially parallel slots 54 defined in each of four outer side surfaces thereof and extending in the longitudinal direction thereof, for installing a pair of sensors 52*a*, 52*b* therein. Each of the cylinder tube 14 and the head cover 18 also has recesses 56 (see FIGS. 1 and 3) defined in the respective four corners thereof and extending in the longitudinal direction thereof. As shown in FIG. 3, the recesses 56 have a curved cross-sectional shape for allowing the attachment holes 32, 34, 36, 38 defined in the rod cover 16 to be exposed.

Figure 2:
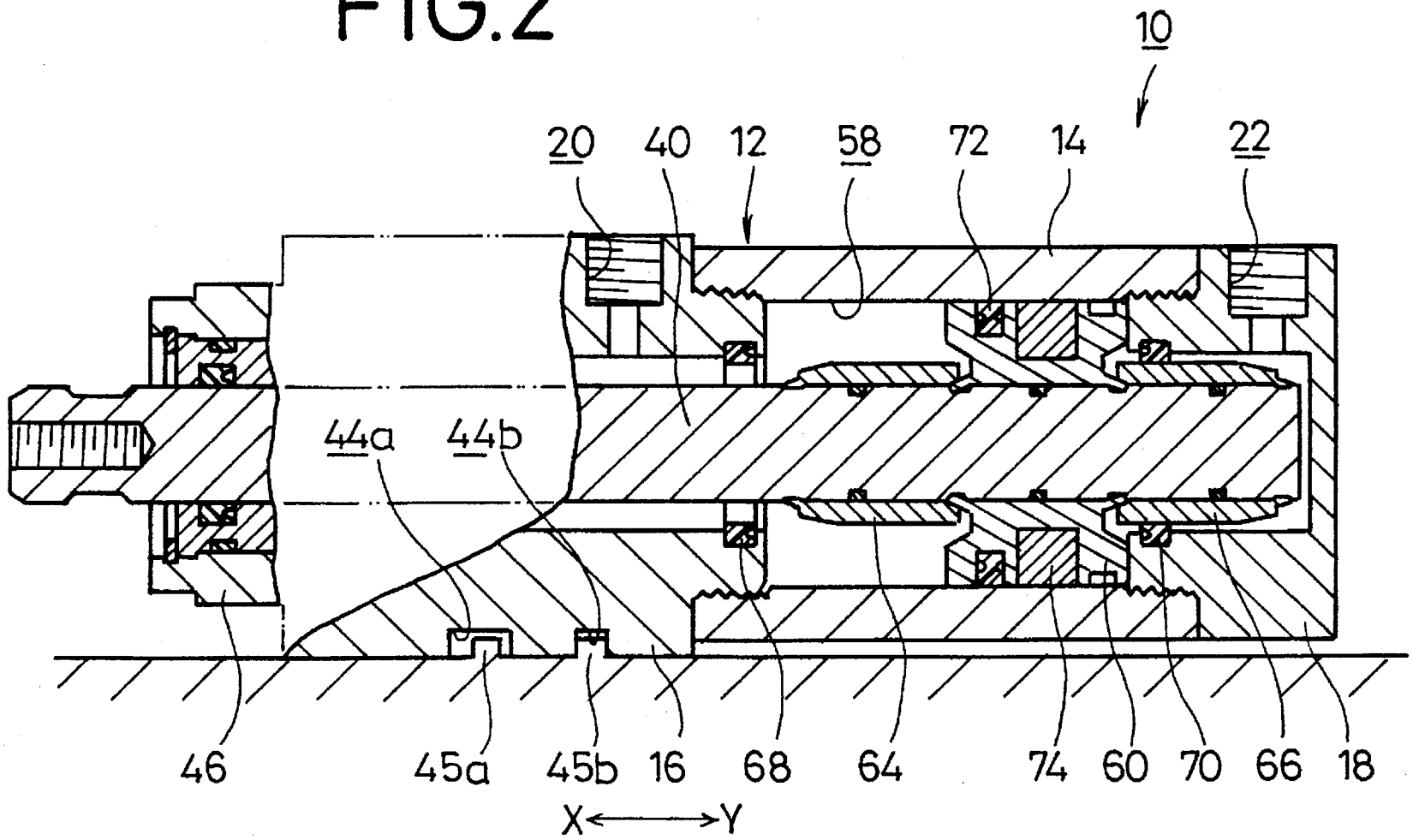
FIG. 2 is a fragmentary longitudinal cross-sectional view of the cylinder device shown in FIG. 1.

As shown in FIG. 2, the cylinder body 12 has a cylinder chamber 58 defined therein which houses a piston 60 slidably movable in the directions indicated by the arrows X, Y. The piston rod 40 is coupled to the piston 60 and extends in the cylinder chamber 58. A pair of tapered collars 64, 66 is fitted over the piston rod 40 closely one on each side of the piston 60. Annular check valves 68, 70 are mounted on respective inner wall surfaces of the rod cover 16 and the head cover 18 for engaging the collars 64, 66, respectively. The piston 60 has annular grooves defined in its outer circumferential surface which receive a ring-shaped seal 72 and a ring-shaped magnet 74, respectively. The bushing 46 is mounted on the rod cover 16, which is of substantially circular cross section and through which the distal end of the piston rod 40 projects out of the rod cover 16.

Operation and advantages of the cylinder device 10 will be described below.

The operator selects those of the attachment holes 24, 26, 28, 30, 32, 34, 36, 38 which are suitable for a device attachment surface depending on the environment in which the cylinder device 10 is to be installed. Then, bolts 42 are inserted through the selected attachment holes to fasten the cylinder device 10 to the desired attachment surface.

Specifically, when the cylinder device 10 is to be installed on an attachment surface substantially parallel to the axis of the piston rod 40, the operator chooses the attachment holes 24, 26, 28, 30, positions the cylinder device 10 accurately on the attachment surface through the positioning recesses 44*a*, 44*b*, and fastens the cylinder device 10 to the attachment surface with the bolts 42. When the cylinder device 10 is to be installed on an attachment surface perpendicular to the axis of the piston rod 40, the operator chooses the attachment holes 32, 34, 36, 38, and inserts bolts 42 through the attachment holes 32, 34, 36, 38, thereby fastening the cylinder device to the attachment surface. At this time, the bushing 46 projecting axially from the rod cover 16 is fitted in a substantially circular positioning hole (not shown) defined in the attachment surface, thereby positioning the cylinder device 10 accurately with respect to the attachment surface. The positioning hole defined in the attachment surface and the bushing 46 should preferably be of substantially the same diameter.

The bolts 42 may be inserted from the side of the bushing 46 or the side of the head cover 18 along the axis of the piston rod 40. If the bolts 42 are inserted from the side of the head cover 18, then since the cylinder tube 14 and the head cover 18 have the recesses 56 in the corners thereof, the bolts 42 can easily be inserted into the attachment holes 32, 34, 36, 38 without being obstructed by the corners of the cylinder tube 14 and the head cover 18.

Consequently, the cylinder device 10 according to the present invention can be mounted on any of various attachment surfaces depending on the environment in which it is to be installed, and can also be fastened to a desired attachment surface highly simply.

After the cylinder device 10 has been installed in place, a fluid is supplied under pressure from a pressure fluid supply device (not shown) through the pressure fluid inlet/output port 22 into the cylinder device 10. The fluid introduced under pressure from the pressure fluid inlet/output port 22 flows through the check valve 70 into a right-hand one (FIG. 2) of subchambers which are defined in the cylinder chamber 58 on opposite sides of the piston 60, thus displacing the piston 60 in the direction X. The piston 60 is displaced under the pressure of the introduced fluid toward a terminal end of its stroke in the cylinder chamber 58.

To move the piston 60 in the opposite direction, i.e., the direction Y, a fluid is introduced under pressure through the pressure fluid inlet/output port 20 into the other subchamber. The piston 60 is now displaced in the direction Y toward the other end of the stroke.

In the illustrated embodiment, each of the four side surfaces of the cylinder tube 14 and the head cover 18 has two slots 54 for installing the sensors 52*a*, 52*b*. However, each of the cylinder tube 14 and the head cover 18 may have one or more slots 54 in one or more side surfaces thereof.

Although a certain preferred embodiment of the present invention has been shown and described in detail, it should be understood that various changes and modifications may be made therein without departing from the scope of the appended claims.

What is claimed is:

1. A cylinder device comprising:

a cylinder body having a cylinder chamber and first and second ports defined therein; and a piston mounted in said cylinder chamber for reciprocating movement in response to introduction of a fluid under pressure through one of said first and second ports and discharge of the fluid through the other of said first and second ports;

a piston rod connected to said piston and extending in said cylinder chamber;

said cylinder body including a cylinder tube, a rod cover, and a head cover which are integrally coupled to each other;

said cylinder tube having recesses defined respectively in four corners thereof and extending along an axis of said piston rod;

said rod cover having first positioning means for positioning said cylinder body to a first attachment surface which extends along said axis of the piston rod, a plurality of first attachment holes defined in said rod cover and extending through said rod cover substantially perpendicularly to said axis of the piston rod for attaching said cylinder body to said first attachment surface, second positioning means for positioning said cylinder body to a second attachment surface which extends substantially perpendicularly to said axis of the piston rod, and a plurality of second attachment holes defined in said rod cover and extending through said rod cover along said axis of the piston rod for attaching said cylinder body to said second attachment surface.

2. A cylinder device according to claim 1, wherein said first positioning means comprises positioning recesses defined in at least one side surface of said rod cover.

3. A cylinder device according to claim 2, wherein said rod cover is substantially rectangular, wherein one side surface and a side surface adjacent to said one side surface each include said positioning recesses and said plurality of first attachment holes.

4. A cylinder device according to claim 1, wherein said second positioning means comprises a bushing having a substantially circular cross section projecting from said rod cover along said axis of the piston rod.

5. A cylinder device according to claim 1, wherein said first positioning means is separate from said first attachment holes.

* * * * *